US012528109B2

(12) United States Patent
Theobald et al.

(10) Patent No.: US 12,528,109 B2
(45) Date of Patent: Jan. 20, 2026

(54) COILBOX AND METHOD FOR THE OPERATION THEREOF

(71) Applicant: SMS group GmbH, Düsseldorf (DE)

(72) Inventors: Frank Theobald, Siegen (DE); Bernhard Ehls, Hilchenbach (DE)

(73) Assignee: SMS group GmbH, Düsseldorf (DE)

( * ) Notice: Subject to any disclaimer, the term of this patent is extended or adjusted under 35 U.S.C. 154(b) by 265 days.

(21) Appl. No.: 18/557,938

(22) PCT Filed: Mar. 24, 2022

(86) PCT No.: PCT/EP2022/057853
§ 371 (c)(1),
(2) Date: Oct. 29, 2023

(87) PCT Pub. No.: WO2022/228791
PCT Pub. Date: Nov. 3, 2022

(65) Prior Publication Data

US 2024/0058854 A1 Feb. 22, 2024

(30) Foreign Application Priority Data

Apr. 30, 2021 (DE) ..... 10 2021 204 375.5

(51) Int. Cl.
*B21C 47/08* (2006.01)
*B21C 47/22* (2006.01)
(Continued)

(52) U.S. Cl.
CPC ..... *B21C 47/08* (2013.01); *B21C 47/22* (2013.01); *B21C 47/24* (2013.01); *B65H 18/023* (2013.01);
(Continued)

(58) Field of Classification Search
CPC ..... B65H 18/00; B65H 18/02; B65H 18/023; B65H 18/025; B65H 18/06; B65H 18/08;
(Continued)

(56) References Cited

U.S. PATENT DOCUMENTS 4,002,308 A * 1/1977 Feighery ..... B65H 19/2276 242/541.2
4,005,830 A * 2/1977 Smith ..... B29C 48/151 242/541.2
4,096,724 A * 6/1978 Eshelman ..... B21C 47/08 72/146
(Continued)

FOREIGN PATENT DOCUMENTS

CN 2732376 10/2005
CN 204448890 U 7/2015
(Continued)

OTHER PUBLICATIONS

Korabi, T, and Wheeler, F M. 1995. "New developments expand Coilbox applications". United States.

*Primary Examiner* — Anna M Momper
*Assistant Examiner* — Raveen J Dias
(74) *Attorney, Agent, or Firm* — Smartpat PLC

(57) ABSTRACT

A coilbox is provided for winding a metal strip to form a coil and for unwinding the metal strip from the coil. In order to further develop a known coilbox in such a manner that the position of the coil is known at all times, in particular during its passive transfer from the winding station to the unwinding station, at least one additional roller rotatably mounted on the frame is provided.

15 Claims, 5 Drawing Sheets

(51) Int. Cl.

| | |
|---|---|
| ***B21C 47/24*** | (2006.01) |
| ***B65H 18/02*** | (2006.01) |
| ***B65H 18/14*** | (2006.01) |
| ***B65H 18/16*** | (2006.01) |
| ***B65H 19/22*** | (2006.01) |

(52) U.S. Cl.
CPC ..... *B65H 18/025* (2013.01); *B65H 18/14* (2013.01); *B65H 18/16* (2013.01); *B65H 19/2246* (2013.01); *B65H 19/2276* (2013.01); *B65H 2301/41358* (2013.01); *B65H 2402/31* (2013.01); *B65H 2701/173* (2013.01)

(58) Field of Classification Search
CPC .... B65H 18/085; B65H 18/14; B65H 18/145; B65H 18/16; B65H 18/20; B65H 19/22; B65H 19/2238; B65H 19/2246; B65H 19/2253; B65H 19/2269; B65H 19/2276; B65H 19/2284; B65H 49/18; B65H 49/24; B65H 49/325; B65H 54/22; B65H 54/40; B65H 54/42; B65H 54/04; B65H 54/12; B65H 54/14; B65H 54/54; B65H 54/56; B65H 2301/41358; B65H 2402/31; B65H 2408/235; B65H 2701/173; B21C 47/00; B21C 47/02; B21C 47/08; B21C 47/16; B21C 47/22; B21C 47/24; B21C 47/242; B21C 47/245; B21C 47/04; B21C 47/06; B21C 47/063
See application file for complete search history.

(56) References Cited

U.S. PATENT DOCUMENTS

| | | | | | |
|---|---|---|---|---|---|
| 4,442,690 | A * | 4/1984 | Hirschmanner | C21D 9/68 | 72/202 |
| 4,761,983 | A * | 8/1988 | Ginzburg | B21C 47/063 | 72/202 |
| 4,842,209 | A * | 6/1989 | Saukkonen | B65H 19/2238 | 242/541.3 |
| 5,310,131 | A * | 5/1994 | Monaco | B21C 47/22 | 242/909 |
| 5,577,684 | A * | 11/1996 | Dropczynski | B65H 19/2246 | 242/533.2 |
| 5,938,144 | A * | 8/1999 | Kaipf | B65H 18/22 | 242/530.4 |
| 5,987,955 | A * | 11/1999 | Benner | B65H 16/08 | 242/538 |
| 8,220,303 | B2 * | 7/2012 | Beuter | B21C 47/24 | 72/146 |
| 8,281,633 | B2 * | 10/2012 | McKenney | B21C 47/28 | 242/533.2 |
| 8,590,124 | B2 * | 11/2013 | Baumer | B21C 47/24 | 242/595.1 |
| 9,108,236 | B2 * | 8/2015 | Jesche | B21C 47/22 | |
| 10,882,709 | B2 * | 1/2021 | Lupi | B65H 18/145 | |
| 2004/0239018 | A1 * | 12/2004 | Kruger | B21C 47/08 | 266/249 |
| 2007/0012082 | A1 | 1/2007 | Baumer et al. | | |
| 2009/0032634 | A1 * | 2/2009 | Beuter | B21C 47/24 | 242/538 |
| 2009/0211324 | A1 | 8/2009 | McKenney et al. | | |
| 2013/0214078 | A1 | 8/2013 | Jesche et al. | | |

FOREIGN PATENT DOCUMENTS

| | | | |
|---|---|---|---|
| EP | 2257395 | A1 | 12/2010 |
| EP | 2616196 | A1 | 7/2013 |
| JP | H09220609 | A | 8/1997 |
| JP | H1034231 | A | 2/1998 |
| JP | 2000005818 | A | 1/2000 |
| WO | 2005028136 | A1 | 3/2005 |

* cited by examiner

COILBOX AND METHOD FOR THE OPERATION THEREOF

CROSS-REFERENCE TO RELATED APPLICATION

This application is a national stage application, filed under 35 U.S.C. § 371, of International Patent Application PCT/EP2022/057853, filed on Mar. 24, 2022, which claims the benefit of German Patent Application DE 10 2021 204 375.5, filed on Apr. 30, 2021.

TECHNICAL FIELD

The disclosure relates to a coilbox for winding a metal strip to form a coil and for unwinding the metal strip from the coil. The term "coil" means in particular a wound metal strip. The disclosure further relates to a system consisting of the coilbox and a coil processed therein. Finally, the disclosure relates to a method for operating the coilbox.

BACKGROUND

Coilboxes are generally known in the prior art. They typically consist of a winding station and an unwinding station downstream of the winding station in the direction of material flow. The winding station and the unwinding station each consist of a plurality of adjustable rollers. Within the coilbox, the coil finished in the winding station must be transferred to the downstream unwinding station. For such transfer of the coil, two basic solutions are known in the prior art, namely active coil transfer and passive coil transfer.

To implement active coil transfer, additional hydraulic actuators are typically required in the region between the winding station and the unwinding station, which are not only cost-intensive but also require additional space between the winding station and the unwinding station. In addition, there is a considerable amount of work involved in commissioning, because the movements of the actuators have to be very precisely matched to the rollers of the upstream winding station and the downstream unwinding station to ensure smooth coil transport. Thus, the technical equipment required for active coil transfer is very large. Examples of active coil transfer can be found described in European patent specifications EP 2 257 395 B1 and EP 2 616 196 B2. The advantage of active coil transfer is that the location or position, as the case may be, of the coil within the coilbox and, in particular, also during transfer from the winding station to the unwinding station is clearly defined at all times. During active coil transfer, a new strip to be wound can therefore already enter the winding station if it is clear from the current position of the last wound coil that it has safely left the winding station or safely reached the unwinding station, as the case may be. In this manner, a high production rate can be achieved with active coil transfer.

So-called passive coil transfer, also known in the prior art, does not offer such advantages. On the other hand, it is much cheaper to implement because it does not require additional system technology. With passive coil transfer, the coil is pulled from the winding station to the unwinding station by the pulling force of the finishing line downstream of the coilbox, if the coil has become so light that the weight force of the coil is no longer sufficient to transfer the torque of the unwinding rollers to the coil, in order to bend the metal strip open. The unwinding of the coil is terminated when its rotary movement stops. Depending on the material, temperature and geometry of the metal strip, passive coil transfer will always start at a calculable coil weight. However, it can happen that the coil is not completely pulled onto the unwinding station, but remains temporarily between the rollers of the winding station and the rollers of the unwinding station. This occurs more frequently with soft material, i.e., at high temperature and with low thicknesses of the metal strip. As such, the position of the coil cannot always be precisely determined during passive coil transfer; i.e., in particular, whether the coil is still between the two stations or is already in the unwinding station remains unclear. However, a new metal strip to be wound can only be released for entry into the winding station of the coilbox if it is ensured that the winding station of the coilbox is completely empty. However, since, with passive coil transfer, the position of the coil is unclear, in particular during the transfer of the coil from the winding station to the unwinding station, and the position of the coil can only be determined unambiguously in the unwinding station, a loss of time arises for passive coil transfer with respect to determining when the coil has definitely left the winding station. This is accompanied by reduced productivity of the system, because the subsequent metal strip to be wound can only be released for entry into the winding station of the coilbox when the previously wound coil has definitely left the winding station.

SUMMARY

The disclosure is based on the object of further designing a known coilbox, a known system consisting of the coilbox and a coil along with a known method for operating the coilbox in such a manner that the position of the coil is known at all times, in particular during its passive transfer from the winding station to the unwinding station, and therefore the point in time when the coil leaves the winding station within the coilbox can also be definitively determined.

This object is achieved with respect to the coilbox by the subject matter as disclosed herein.

This subject matter is characterized in that at least one additional roller rotatably mounted on the frame is provided, in that the axis of rotation of the additional roller is parallel to the axes of rotation of the first to fourth rollers, and in that the axis of rotation of the additional roller is positioned on the frame in such a manner that its radial distance xz to the point of rotation of the frame is greater than the radial distance x2 of the point of rotation of the second roller to the point of rotation of the frame and that its radial distance xz plus the radius of the additional roller is smaller than the minimum radial distance x3 of the point of rotation of the third roller to the point of rotation of the frame, minus the radius of the third roller, and in that the uppermost point of the additional roller in a first transition position, in which the uppermost points of the first and second rollers form a horizontal roller table plane, is arranged at a predetermined distance w below such roller table plane. This protects the additional roller and, if necessary, also the other additional roller at least somewhat from the heat radiation emitted by the coil, which as a rule is still warm. This is sensible, and may even be necessary, because in this phase there is also no additional strip contact that extracts additional heat from the rolled material.

The additional roller offers the advantage that the position of the coil during its transfer from the winding station to the unwinding station and the point in time when the coil leaves the winding station can be determined better or more precisely, as the case may be. This results in the advantage that the production rate can be increased compared to the traditional passive transfer, because the winding of the subsequent strip can start earlier. Further explanations are given in the description of the exemplary embodiments.

According to one exemplary embodiment, the transfer of the coil from the winding station to the unwinding station can advantageously be facilitated by providing at least one displacement device for optionally and individually displacing the third and/or the fourth roller, which form the unwinding station, below the roller table plane E1 formed by the first and second roller in a first transition position.

According to a further exemplary embodiment, a further additional roller is rotatably mounted between the second roller and the additional roller on the frame. Such additional roller is positioned on the frame in such a manner that its outer circumference projects beyond a notional tangential connecting line—facing the roller table plane E1—between the outer circumferences of the second roller and the additional roller. The provision of the further additional roller makes it even easier to determine the position of the coil and the point in time at which it leaves the winding station. In addition, the further additional roller offers the advantage that the transfer of the coil from the first via the second to the third transition position is kinematically smoother, because the further additional roller pre-positions the coil even before the additional roller engages on the coil.

Advantageously, the coilbox further has a position detector for generating a position indication, which represents the position of the additional roller, in particular if the additional roller is raised to the level of the roller table plane formed by the first roller and the second roller in the first transition situation or beyond. Advantageously, the position of the additional roller in turn also represents the position of the coil during coil transfer.

The object specified above is further achieved by a system as disclosed herein, which comprises the coilbox and a coil wound therein. Finally, the object is further achieved by the method as disclosed herein. The advantages of these two solutions correspond to those mentioned above with reference to the claimed coilbox. Advantageous embodiments of the coilbox, the system and the claimed method are the subject matter of the dependent claims.

DETAILED DESCRIPTION

The invention is described in detail below with reference to the specified figures in the form of exemplary embodiments. In all figures, the same technical elements are designated with the same reference signs.

Figure 1:
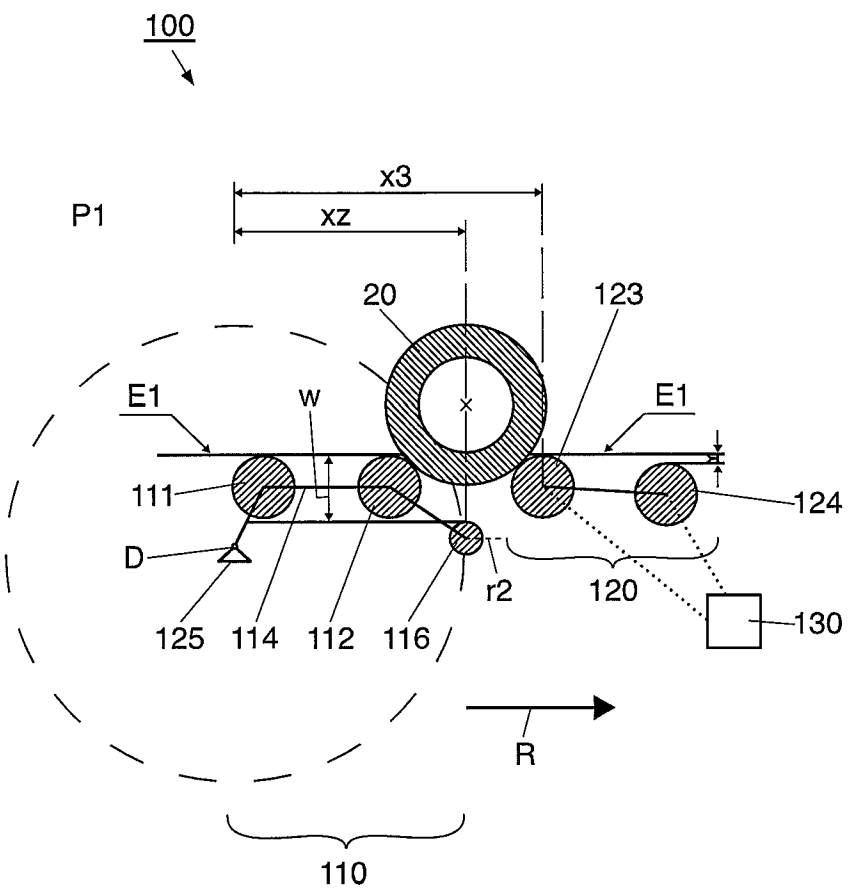
FIG. 1 shows a coilbox, comprising a winding station and an unwinding station in a first transition position.

FIG. 1 shows the coilbox 100. It consists of a winding station 110 for winding a metal strip to form a coil and an unwinding station 120. The winding station 110 and the unwinding station 120 each in turn consist of a plurality of rollers for transporting the metal strip in the direction of transport R. In the winding station, a first roller 111, a second roller 112 and, as a special feature, an additional roller 116 are provided, all of which are rotatably mounted on a common frame 114. The frame 114 with said rollers is mounted to pivot through an angle of rotation a about a point of rotation D. A rotary drive 125 is provided for pivoting the frame 114. The term "rotary drive" also includes a translationally acting lifting cylinder with which the rotary or pivoting movement, as the case may be, can also be realized.

The unwinding station 120 consists of at least a third roller 123 and a fourth roller 124, which can be individually displaceable at least in the vertical direction, i.e. in their height. The vertical displacement or height difference can be variable at any time by means of a displacement device 130, or can be fixed once by means of so-called intermediate plates and then remain unchanged in this position, or can be fixed in a structurally immovable manner. The design by means of the intermediate plates offers the advantage that fewer setting functions are required. With the first roller 111, the second 112, the third roller 123 and the fourth roller 124 horizontally aligned, all of these four rollers form a horizontal roller table E1 in their home or starting position. They are arranged one behind the other in the direction of transport R. The axes of rotation of all rollers, including the additional roller 116, are arranged parallel to one another. The additional roller 116 is arranged on the frame 114 in such a manner that its radial distance xz from the point of rotation D of the frame 114 is greater than the radial distance x2 of the point of rotation of the second roller 112 from the point of rotation D of the frame. Furthermore, the radial distance xz of the additional roller 116 plus the radius of the additional roller is smaller than the minimum radial distance x3 of the point of rotation of the third roller 123 to the point of rotation D of the frame 114, minus at least the radius r3 of the third roller 123. In particular, a collision with the roller 3 must be/is excluded by design. Finally, in a first transition position P1 of the frame 114 and of the rollers arranged thereon shown in FIG. 1, in which the uppermost points of the first and second rollers form the specified horizontal roller table plane E1, the uppermost point of the additional roller 116 is arranged at a predetermined distance w below the specified roller table plane E1. Between the second roller 112 and the additional roller 116, a further additional roller 115 can also be rotatably mounted to the frame 114. The further additional roller 115 is then positioned on the frame 114 in such a manner that it projects with its outer circumference over a notional tangential connecting line V—facing the roller table plane—between the outer circumferences of the second roller 112 and the additional roller 116.

The diameters of the additional roller 116 and the further additional roller 115 are smaller than the diameters of the first to fourth rollers, for example ⅔ or ½.

Furthermore, the coilbox can have a position detector 140 for generating a position signal, which represents the position of the additional roller, in particular if the additional roller 116 is raised to the level of the horizontal roller table plane E1 formed by the first roller 111 and the second roller 112 in the first transition position P1 or beyond. The position sensor 140 can also be designed to sense the position of the frame 114, in which case the position of the additional roller can be determined using a kinematic relationship. With this exemplary embodiment, the recorded position of the frame is representative of the position of the additional roller.

At the beginning of the winding station 110, there is typically a forming region with infeed rollers for guiding new metal strip entering the coilbox and with bending rollers and a forming roller for forming the beginning of the new metal strip to form a coil eye for a coil to be rewound in the winding station. However, the forming region of the winding station 110 is not shown in the figures. In the forming region of the winding station, the incoming metal strip is wound into the coil 20 and initially deposited on the first roller 111 and the second roller 112 of the winding station 110, wherein the first and second rollers are horizontally aligned and form the horizontal roller table plane E1. Within the framework of the present disclosure, such position is referred to as the starting position for these two rollers. For example, by briefly pivoting the frame 114 clockwise, the coil is caused to slide from its depositing position on the first two rollers 111 and 112 to the first transition position P1 shown in FIG. 1. In such first transition position P1, the coil 20 is carried solely by the second roller 112 of the winding station 110 and the third roller 123 of the unwinding station 120. As soon as the coil 20 has reached this first transition position P1, the frame 114 is then pivoted back to its starting position, as shown in FIG. 1. Alternatively, or in addition to the brief pivoting of the frame 114 clockwise and counterclockwise, the coil can also be pulled to the first transition position P1 by applying a pulling force to the free end of the metal strip wound into the coil. The pull on the free end of the metal strip in the direction of transport R can be applied, for example, by a rolling mill stand downstream of the coilbox if the free end of the metal strip wound into the coil is clamped in the roll gap of the rolling mill stand. The rolling mill stand is not shown in the attached figures.

The method for operating the coilbox aims at transferring the wound coil 20 within the coilbox 100 from the winding station 110 to the winding station 120 via a plurality of transition positions P1, P2 and P3 and a transfer position P4 in the direction of transport R.

In the first transfer position shown in FIG. 1, the coil 20 is carried solely by the second roller 112 and the third roller 123. For transferring the coil 20 into the unwinding station 120, in a first method step, the frame 114 is pivoted counterclockwise by an angle $\alpha$P2 only so far that the additional roller 116 rests against the outer circumference of the coil 20.

Figure 2:
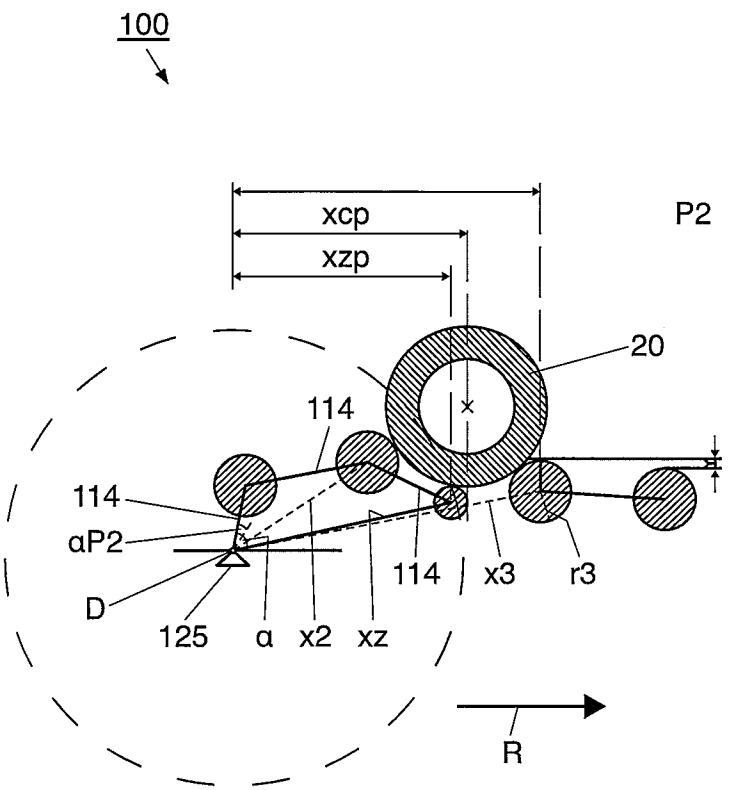
FIG. 2 shows the coilbox with the winding station in a second transition position.
Figure 3:
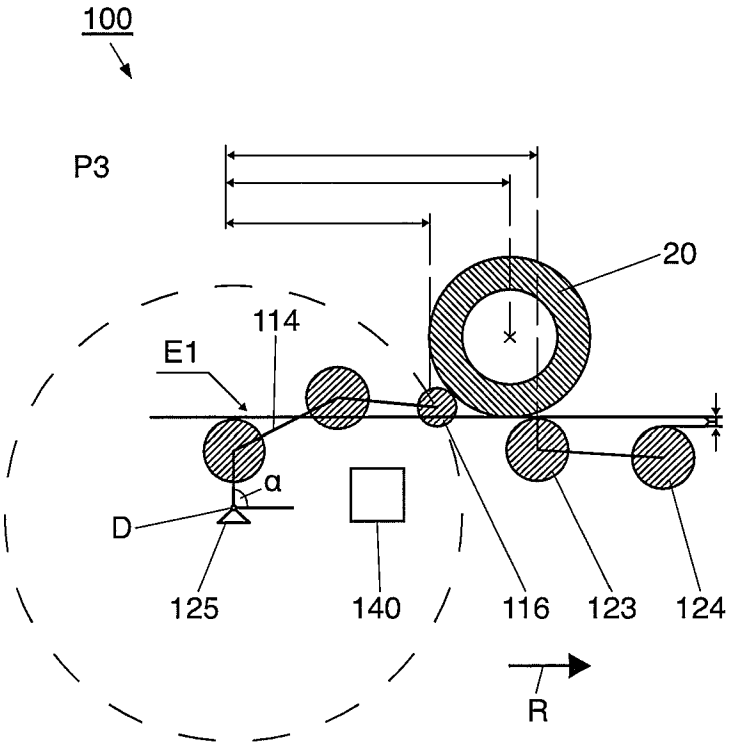
FIG. 3 shows the coilbox with the winding station in a third transition position.
Figure 6:
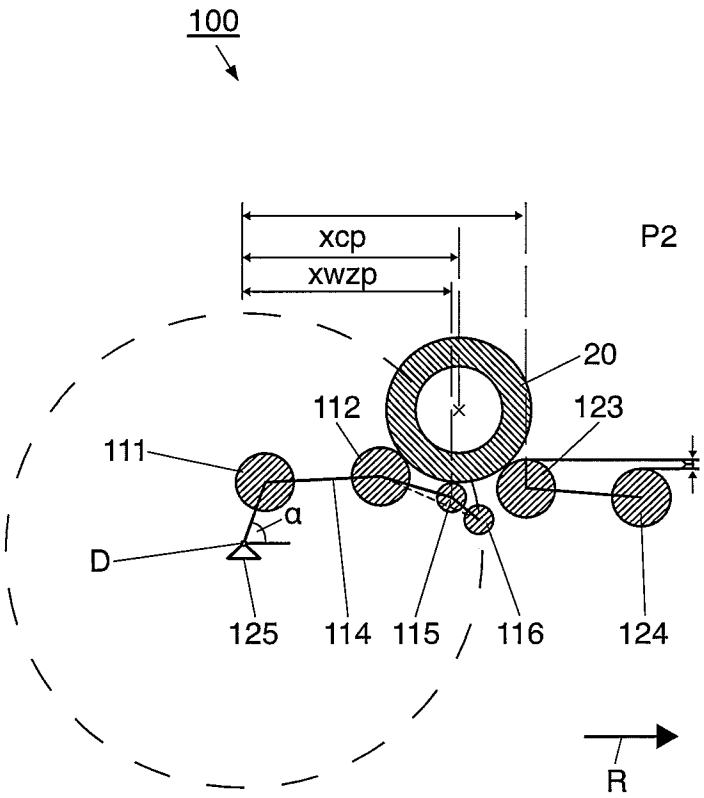
FIGS. 5-8 correspond to FIGS. 1 to 4, with the only difference that a further additional roller is now rotatably arranged between the second roller of the winding station and the additional roller.

This designates the second transition position P2 as shown in FIG. 2. In this situation, it is important that the distance xzp projected into the horizontal between the axis of rotation in the additional roller 116 and the point of rotation of the frame 114 is less than the distance xcp projected into the horizontal between the center of gravity of the coil 20 and the axis of rotation D of the frame 114. The specified relationship between the distances xcp and xzp ensures that the coil 20 is not only raised during a subsequent further counterclockwise pivoting or rotation, as the case may be, of the frame 114, but also transferred further in the direction of transport R to the third transition position shown in FIG. 3.

Figure 4:
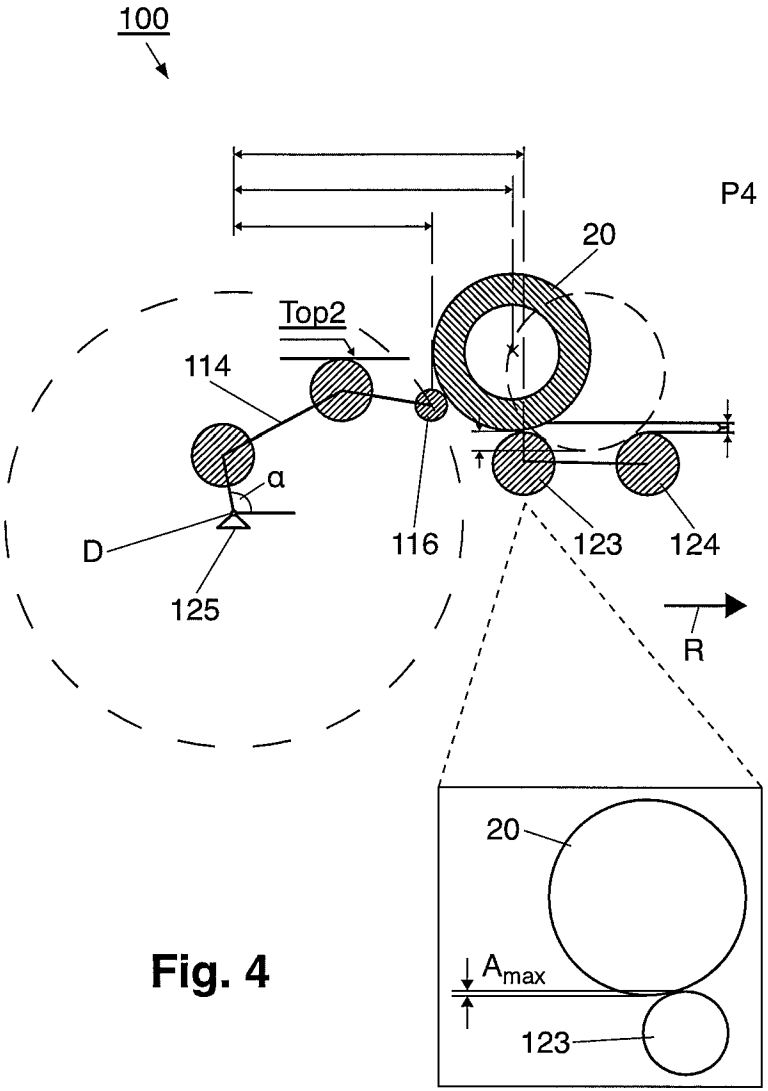
FIG. 4 shows the coilbox with the winding station in a transfer position.

In such third transition position, the coil is carried only by the additional roller 116 and the third roller 123. However, the axis of rotation of the additional roller 116 is still below a notional connecting line between the point D of the frame 114 and the center axis of the coil 20. Only when the frame 114 is pivoted a little further counterclockwise, such that the axis of rotation of the additional roller 116 is on the connecting line between the axis of rotation D of the frame and the center point of the coil eye, has the coil 20 reached the transfer position P4 shown in FIG. 4. The coil 20 is now in a quasi-stable equilibrium state, because its center of gravity is exactly over the center point of the axis of rotation of the third roller 123. A further transport of the coil 20 to the target position indicated by dashed lines in FIG. 4, in which the coil 20 lies stably on the third roller 123 and the fourth roller 124 of the unwinding station 120, can now no longer be achieved by the further pivoting of the frame 114. Instead, the coil is moved from the unstable equilibrium state into the stable bearing on the rollers 123 and 124 by applying a strip tension to the free end of the coil wound into the metal strip in the direction of transport R. In the transfer position P4, the coil 20 can be lowered with the lowermost point on its outer circumference by no more than a predetermined permissible maximum distance $A_{max}$ below the upper edge of the third roller 123. This is the prerequisite for the aforementioned pulling of the coil 20 into the stable equilibrium position, as shown in dashed lines in FIG. 4, to be realized by strip tension alone. In order to facilitate the transition of the coil 20 from the transfer position P4 to the stable support on the third and fourth rollers 123, 124, the fourth roller 124 can be lowered with respect to the horizontal plane E1, as shown in FIG. 4.

Figure 8:
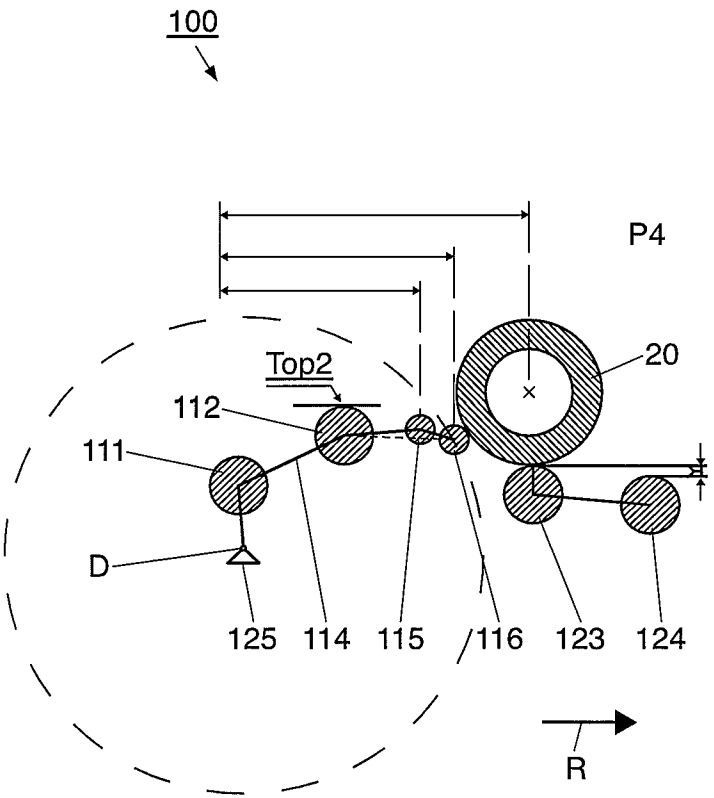
Figure 7:
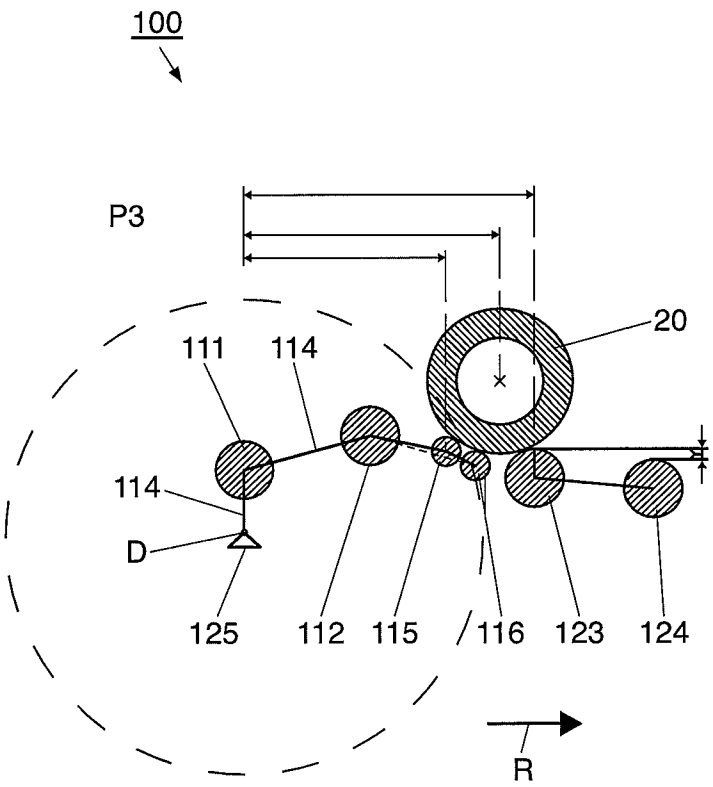
Figure 9:
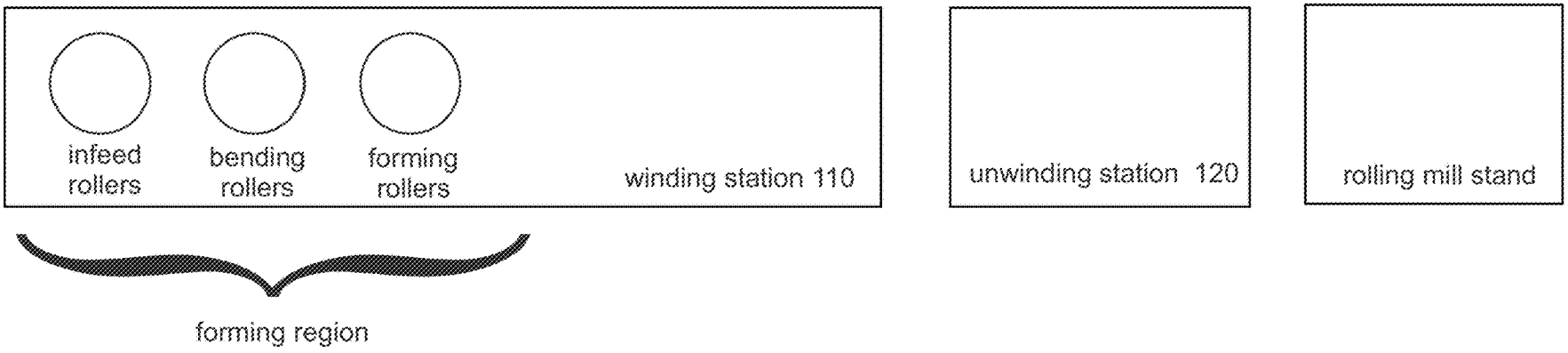
FIG. 9 schematically shows the winding station with a forming region having infeed rollers, bending rollers, and forming rollers. Downstream of the winding station are the unwinding station and a rolling mill stand.

FIGS. 5 to 8 show a second exemplary embodiment, wherein in addition to the additional roller 116, a further additional roller 115 is rotatably mounted on the frame 114. The exact positioning of the further additional roller 115 on the frame has already been described above. FIGS. 5 to 8 show, analogously to FIGS. 1 to 4, the different transition positions P1, P2 and P3, respectively, through which the coil 20 has to pass before it reaches the transfer position P4, which is shown in FIG. 8 for the second exemplary embodiment. The transition positions P1, P2 and P3 along with the transfer position P4 are achieved in particular by pivoting the frame 114 increasingly further counterclockwise. In the transfer position P4, the second roller 112 in particular, but also the further additional roller 115 and the additional roller 116 reach their respective upper end point. For the second roller 112, this is marked Top2. This applies both to the first exemplary embodiment without the further additional roller and to the second exemplary embodiment with the further additional roller.

Figure 5:
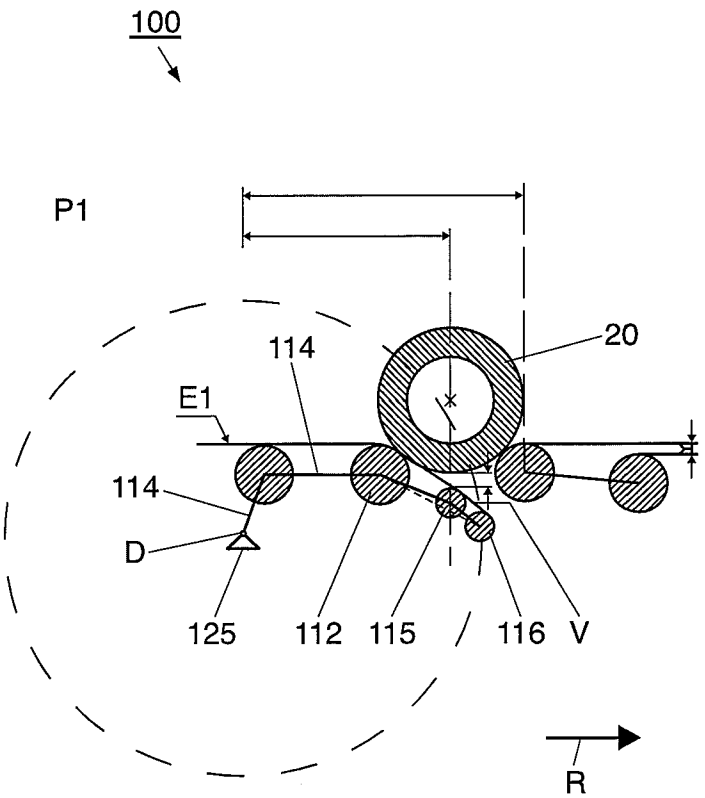

In the first transition position P1 in accordance with FIG. 5, it can be seen that the coil 20 is initially carried by the second roller 112 and the third roller 123 alone. Both the further additional roller 115 and the additional roller 116 are still arranged below the coil 20 without contacting it. Only upon the transition from the first transition position to the second transition position in accordance with FIG. 6, when the frame 114 with the rollers arranged on it is pivoted counterclockwise, does the additional roller 115 come into contact with the outer circumference of the coil 20 in addition to the second and third rollers. Here as well, analogous to the description of FIG. 2, it is important that the distance xcp projected into the horizontal between the center point of the coil 20 and the axis of rotation D of the frame 114 is greater than the distance xwzp projected into the horizontal between the axis of rotation of the further additional roller brought into contact and the point of rotation D of the frame 114. The rationale for such spacing criterion is the same as explained in the description of FIG. 2, namely that when the frame 114 is pivoted further, the coil 20 must not only be raised, but should also experience a component of force in the direction of transport R.

Upon the transition from the second transition position P2 to the third transition position P3 through the further counterclockwise pivoting of the frame 114, the coil 20 is detached from the second roller 112 and instead the additional roller 116 continues to bear against the coil 20. The coil 20 is now supported by the further additional roller 115, the additional roller 116 and the third roller 123; see FIG. 7.

By pivoting the frame 114 even further counterclockwise about the axis of rotation D, the coil 20 is pushed or displaced, as the case may be, even further in the direction of transport R and thus reaches the transfer position P4; see FIG. 8. In such transfer position P4, the coil 20 has become detached from the further additional roller 115 and now rests only on the additional roller 116 and the third roller 123. In such transfer position, the coil 20 is in an unstable equilibrium situation. All rollers on the frame 114 have each reached their upper end position; this is also indicated here by the reference sign Top2 for the second roller 112. In the transfer position P4, the additional roller 116 with its center point lies on a notional connecting line between the point of rotation D of the frame 114 and the center of the coil 20. In the ideal case, if the position TOP2 allows it, the upper end position will be limited if necessary. With this exemplary embodiment, the coil 20 can also be transferred from the unstable equilibrium position to a stable equilibrium position either by a pull on the free end of the strip in the direction of transport R and/or by lowering the third roller 123 below the plane E1, wherein the coil 20 then rests on the third roller 123 and the fourth roller 124 of the unwinding station 120. The movement of both the third roller 123 and the fourth roller 124, in particular in the vertical direction, can be realized by the displacement device 130, which engages on the rollers or in other manners, as explained above within the framework of the description of FIG. 1. A lowering of the fourth roller 124, possibly also by a fixed amount, makes it easier, on the one hand, to deposit the coil in the unwinding station and, on the other hand, to forward the unwound metal strip to a downstream processing device, for example a rolling mill stand.

For both exemplary embodiments, a position detector can be provided for generating a position signal, which signals that at least one of the rollers 111, 112, 115, 116 rotatably mounted on the frame 114 has reached the transfer position P4 and thus its respective upper end position Top2. Such position signal is used as a confirmation signal that the coil has safely left the winding station. Only in response to the confirmation signal generated in this manner is the entry of a new metal strip into the forming region of the coilbox 100 permitted for forming a new coil. By providing the additional roller 116 and possibly the further additional roller 115, the basically passive coil transport is enriched to the extent that now, by providing the additional roller, the position of the coil can be reliably detected at any time upon the transition between the winding station 110 and the unwinding station 120, in particular by detecting the positions of the additional roller 116 and/or the further additional roller 115, with the aim of increasing the productivity of a coilbox with purely passive coil displacement without further active actuating elements.

LIST OF REFERENCE SIGNS

100 Coilbox
110 Winding station
111 First roller
112 Second roller
114 Frame
115 Further additional roller
116 Additional roller
120 Unwinding station
123 Third roller
124 Fourth roller
125 Rotary drive
130 Displacement device
140 Position detector
20 Coil
α Angle of rotation of the frame
αP2 Angle of rotation of the frame in position P2
$A_{max}$ Maximum distance
D Point of rotation
E1 Horizontal roller table plane
P1 First transition position
P2 Second transition position
P3 Third transition component
P4 Transfer position
R Direction of material flow=direction of transport of the coil
TOP2 Highest position of the second roller
V Notional connecting line
w Predetermined distance
r2 Radius of roller 116
r3 Radius of roller 123
xcp Distance projected
xzp Distance projected
x2 Radial distance
x3 Radial distance
xz Radial distance

The invention claimed is:

1. A coilbox (100), comprising:

a winding station (110) for winding a metal strip to form a coil (20),
wherein the winding station is formed by a plurality of rollers, including
a first roller (111), a second roller (112),
and at least one additional roller (116) that are rotatably mounted
on a common frame (114);

a rotary drive (125) for pivoting the frame (114) with the first roller (111) and the second roller (112) through an angle of rotation (α) about a point of rotation (D) in a region of the first roller (111) between
a winding position, in which the metal strip is wound to form the coil (20), through a plurality of transition positions (P1, P2, P3), into
a transfer position (P4) for transferring the coil (20) to an unwinding station (120);

the unwinding station (120) in which, the metal strip can be unwound from the coil (20), including at least
a third roller (123) and
a fourth roller (124);

wherein the unwinding station (120) is arranged downstream of the winding station (110) in a direction of material flow (R), and wherein the second roller (112) is arranged downstream of the first roller (111) and the fourth roller (124) is arranged downstream of the third roller (123) in the direction of material flow (R), and wherein axes of rotation of all rollers are aligned parallel to one another, and wherein the axis of rotation of the additional roller (116)

is positioned on the frame (114) in such a manner that
a radial distance (xz) from the point of rotation (D) of the frame (114) to the axis of rotation of the additional roller (116)

is greater than a radial distance (x2) from the point of rotation of the frame to the axis of rotation of the second roller; and the radial distance (xz) from the the axis of rotation (D) of the frame (114) to the axis of rotation of the additional roller (116)

plus a radius of the additional roller (116)

is smaller than a minimum radial distance (x3) from the axis of rotation of the third roller (123) to the point of rotation (D) of the frame (114), minus at least a radius of the third roller, and an uppermost point of the additional roller in a first transition position (P1) of the plurality of transition positions (P1, P2, P3), in which uppermost points of the first roller and the second roller form a horizontal roller table plane (E1), is arranged at a predetermined distance (w) below the horizontal roller table plane (E1).

2. The coilbox (100) according to claim 1, wherein in the transfer position (P4), the second roller (112) has reached its upper end position (TOP2).

3. The coilbox (100) according to claim 1, wherein a diameter of the additional roller (116) is smaller than a diameter of the first, second, third or fourth roller.

4. The coilbox (100) according to claim 1, wherein at least one displacement device (130) is provided for individually displacing the third and/or the fourth roller (123, 124) below the horizontal roller table plane (E1) formed by the first and second rollers (111, 112).

5. The coilbox (100) according to claim 1, further comprising a further additional roller (115) rotatably mounted on the frame between the second roller (112) and the additional roller (116), wherein the further additional roller is positioned on the frame (114) in such a manner that it projects with an outer circumference over a notional tangential connecting line (V), facing the horizontal roller table plane (E1), between the outer circumferences of the second roller (112) and the additional roller (116).

6. The coilbox (100) according to claim 1, further comprising a position detector (140) for generating a position signal, which represents the position of the additional roller (116) when the additional roller is raised to or beyond a level of the horizontal roller table plane (E1) formed by the first roller (111) and the second roller (112) in the first transition position (P1).

7. The coilbox (100) according to claim 1, further comprising a forming region arranged at a beginning of the winding station (110), the forming region having infeed rollers for guiding a new metal strip entering the coilbox and having bending rollers and a forming roller for forming a beginning of the new metal strip to form a coil eye for a new coil to be rewound in the winding station.

8. The coilbox (100) according to claim 7, wherein, when winding the new metal strip into the new coil in the winding station, the frame (114) is pivoted by the rotary drive (125) into the winding position, in which the first and second rollers form an inclined plane towards the forming region.

9. A system, comprising:

the coilbox (100) according to claim 1; and a coil (20), wherein the additional roller (116) is further rotatably mounted on the frame (114) in such a manner that, if the frame is pivoted from the first transition position (P1) by an angle of rotation (αP2) into a second transition position (P2) of the plurality of transition positions (P1, P2, P3), in which the additional roller (116) initially contacts the coil (20) carried by the second and third roller (112, 123), a horizontal distance (xzP) between the axis of rotation of the additional roller (116) and the point of rotation of the frame (114) is smaller than a horizontal distance (xcP) the center of gravity of the coil and the point of rotation (D) of the frame (114).

10. The system according to claim 9, wherein, if the frame is pivoted beyond a third transition position (P3) of the plurality of transition positions into the transfer position (P4) and the coil (20) is supported only by the third roller (123) and the additional roller (116), the coil (20) is lowered with a lowermost point on its outer circumference no more than a predetermined permissible maximum distance (Amax) below an upper edge of the third roller (123).

11. A method for operating the coilbox (100) according to claim 1, comprising:

winding the metal strip to form a wound coil (20) in the winding station of the coilbox;

transferring the wound coil (20) via the plurality of transition positions (P1, P2, P3) within the winding station (110) into the unwinding station (120) of the coilbox (100) arranged downstream in the direction of material flow (R) by applying a pulling force to a start of the metal strip that has been wound to form the coil and by lifting at least the second roller (112) of the winding station into the transfer position (P4) by pivoting about the point of rotation (D) of the frame;

pivoting, in order to reach the transfer position (P4), the frame with the first and second roller rotatably mounted thereon along with the additional roller (116) about the point of rotation of the frame (D) to such an extent that the additional roller (116) is raised above the horizontal roller table plane (E1) formed by the first roller (111) and the second roller (112) in the first transition position (P1); and supporting the coil (20) in a quasi-labile equilibrium in the transfer position (P4) only by the third roller (123) and the additional roller (116).

12. The method according to claim 11, further comprising:

generating a position signal if the additional roller (116) is raised above the horizontal roller table plane (E1) formed by the first roller (111) and the second roller (113) in their starting position and has reached its respective upper end position (TOP2) in the transfer position (P4), and using the position signal as a confirmation signal that the coil (20) has safely left the winding station (110).

13. The method according to claim 12, further comprising:

permitting entry of a new metal strip into a forming region of the coilbox (100) for forming a new coil only in response to the confirmation signal.

14. The method according to claim 11, further comprising:

applying a pulling force to a beginning of the metal strip that has been wound into the coil (20) and/or lowering the third roller (123) with respect to the horizontal roller table plane (E1) for transferring the coil from the transfer position (P4) to the unwinding station (120), where the coil is stably supported on the third and fourth rollers (123, 124).

15. The method according to claim 14, wherein the pulling force is applied by a rolling mill stand, arranged downstream of the unwinding station (120) in the direction of material flow, for rolling the metal strip.

* * * * *